US009789992B2

(12) United States Patent
Fortner

(10) Patent No.: US 9,789,992 B2
(45) Date of Patent: Oct. 17, 2017

(54) DRAWN AND IRONED AEROSOL CAN

(71) Applicant: Crown Packaging Technology, Inc., Alsip, IL (US)

(72) Inventor: Thomas Edward Fortner, Chicago, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/773,997

(22) PCT Filed: Mar. 10, 2014

(86) PCT No.: PCT/US2014/022556
§ 371 (c)(1),
(2) Date: Sep. 9, 2015

(87) PCT Pub. No.: WO2014/159215
PCT Pub. Date: Oct. 2, 2014

(65) Prior Publication Data

US 2016/0031584 A1 Feb. 4, 2016

Related U.S. Application Data

(60) Provisional application No. 61/781,367, filed on Mar. 14, 2013.

(51) Int. Cl.

| | |
|---|---|
| ***B65D 25/54*** | (2006.01) |
| ***B65D 1/16*** | (2006.01) |
| ***B65D 83/38*** | (2006.01) |
| ***B21D 22/28*** | (2006.01) |
| ***B65D 1/02*** | (2006.01) |

(52) U.S. Cl.
CPC ..... *B65D 1/165* (2013.01); *B21D 22/28* (2013.01); *B65D 1/0207* (2013.01); *B65D 1/0223* (2013.01); *B65D 83/38* (2013.01)

(58) Field of Classification Search
CPC ..... B65D 1/165; B65D 7/36; B65D 17/08
USPC ..... 220/623
See application file for complete search history.

(56) References Cited

U.S. PATENT DOCUMENTS

| | | | | |
|---|---|---|---|---|
| 4,294,373 | A | 10/1981 | Miller et al. | |
| 4,423,823 | A * | 1/1984 | Franek | B21D 51/32 156/203 |
| 5,915,587 | A | 6/1999 | Kramer | |
| 7,140,223 | B2 | 11/2006 | Chupak | |
| 2004/0035871 | A1* | 2/2004 | Chupak | B21D 22/28 220/608 |
| 2005/0218148 | A1* | 10/2005 | Boltshauser | B65D 83/38 220/626 |

(Continued)

FOREIGN PATENT DOCUMENTS

| | | | |
|---|---|---|---|
| CH | 486369 | A | 2/1970 |
| EP | 1927554 | A1 | 6/2008 |
| FR | 2543923 | A1 | 10/1984 |

(Continued)

*Primary Examiner* — Shawn M Braden
(74) *Attorney, Agent, or Firm* — Baker & Hostetler LLP

(57) ABSTRACT

A drawn and ironed can body includes relatively thick base having a relatively large standing ring and a beveled outer wall, enhancing the pressure rating of the can body for use with aerosols. A combination steel aerosol end and aluminum can body includes a seam that overcomes or improves prior art fracture problems.

34 Claims, 7 Drawing Sheets

(56) References Cited

U.S. PATENT DOCUMENTS

2009/0090713 A1* 4/2009 Berkefeld ..... B65D 83/48
220/203.19

FOREIGN PATENT DOCUMENTS

| | | | |
|---|---|---|---|
| FR | 2954296 | A3 | 6/2011 |
| GB | 1311949 | A | 3/1973 |

* cited by examiner

DRAWN AND IRONED AEROSOL CAN

CROSS-REFERENCE TO RELATED APPLICATIONS

This application is the National Stage of International Application No. PCT/US2014/022556, filed Mar. 10, 2014, which claims the benefit of U.S. Provisional Application No. 61/781,367 filed Mar. 14, 2013, the disclosures of which are incorporated herein by reference in their entireties for any and all purposes.

BACKGROUND

The present invention relates to packaging, and more particularly to metal aerosol containers and methods for same.

Aerosol containers in the U.S. are rated by the Department of Transportation into three internal pressure ratings. Unrated containers are rated for up to 140 psi. Category 2P containers are rated for up to 160 psi. Category 2Q containers are rated for up to 180 psi. The DOT ratings are related to buckle performance. The burst requirement is 1.5 times the above pressure ratings.

A type of popular, conventional aerosol can is referred to as a three piece can, in which the parts are (i) a can "body" formed by rolling a flat sheet and welding the vertical seam, (ii) a "bottom" attached to the body by a seam, and (iii) an "end" seamed onto the top of the body. The end is dome-shaped. A flange for seaming to the can body is formed at the bottom of the aerosol end. A curl for receiving a valve is formed at the top of the aerosol end. Prior art aerosol cans include steel ends on steel bodies, aluminum ends on aluminum bodies, and aluminum ends on steel bodies.

Another conventional aerosol can includes an integral bottom and body formed in a process referred to as impact extrusion, such as sold by Exal. The impact extrusion process rams a slug of aluminum into the can body shape. Impact extrusion forms a relatively thick base. Shaped cans are also in the marketplace.

U.S. Pat. No. 7,140,223, entitled "Method Of Producing Aluminum Container From Coil Feedstock," discloses an aluminum aerosol container formed by a drawing and ironing process in which a blank cut from an coil is first drawn into a cup and then ironed to increase the sidewall height and reduce the sidewall thickness.

Aerosol cans are rated for significantly higher internal pressure than that for beverage cans, which typically are rated for 85 psi or 90 psi internal pressure. Most beverage cans are formed in a drawing and ironing process that begins with an aluminum (or steel) sheet. After a first stage draws a flat blank into a cup and the second stage irons the sidewall. Modern beverage cans have a base thickness of approximately 0.0105 inches.

Conventional 12 ounce, drawn and ironed beverage are produced in vast quantities. Some aluminum bottles, such as the Alumitek™ bottle shown in FIG. 6, are formed from a drawing and ironing process. The Alumitek™ bottle has a conventional 211 body (that is, a nominal diameter of two and eleven sixteenths inches), a beveled heel, a standing ring that is approximately 75% of the body diameter, and dome (not shown in FIG. 6) that is inboard of the standing ring. The top of the Alumitek™ bottle has a neck that tapers to a threaded opening and a roll-on pilfer-proof cap.

SUMMARY

A drawn and ironed can body has a neck for seaming onto an aerosol end. The present invention encompasses an aluminum, drawn base that is suitable for the high pressure ratings of aerosol containers. Also, a minimum cover hook dimension (as defined as a percentage of the internal seam height) of the double seam overcomes or improves a seam fracture problem that is particular to an aluminum body and steel end.

In this regard, a one-piece, drawn and wall ironed aerosol can body, which is suitable for being seamed onto a dome-type aerosol end, includes a neck having a flange at an uppermost end; a cylindrical sidewall that extends downwardly from the neck; and a base. The base is integral and has a dome, a circular standing ring located outboard of dome, and an outer wall located between the standing ring and a bottom of the sidewall. The standing ring has a diameter that is at least 78 percent of the outside diameter of the sidewall.

According to the another aspect of the present invention, the aerosol can assembly includes a steel end having an opening for receiving a valve assembly; a one-piece, drawn and wall ironed, aluminum can body that includes an base, a sidewall, and a neck; and a double seam formed between the steel end and the aluminum body. The seam includes a seaming panel, an end hook and a body hook. The seam defines an internal seam height defined between an inner surface of the end hook and an inner surface of the seaming panel. The length of the body hook is at least 83 percent of the internal seam height.

A method for seaming a steel aerosol end to an aluminum aerosol can body includes the steps of: locating a steel end relative to a one-piece, drawn and wall ironed, aluminum can body that includes an base, a sidewall, and a neck; and forming a double seam between the steel end and the aluminum can body such that the seam includes a seaming panel, an end hook, and a body hook; the seam defining an internal seam height defined between an inner surface of the end hook and an inner surface of the seaming panel, a length of the body hook is at least 83 percent of the internal seam height.

Each of the above definitions of the inventive can body, combination can body and end, and method for forming the can body and end have structural attributes that are preferred. In this regard, the standing ring has a diameter that is at least 78% of the outside diameter of the sidewall, preferably at least 80 percent and more preferably at least 82 percent of the outside diameter of the sidewall. The upper limit of the ratio of standing ring diameter to outside sidewall diameter is a practical one related to outer base wall strength, the particular thickness for the application, internal pressure, and like parameters.

The base is at least 0.018 inches thick everywhere within the standing ring, and preferably at least 0.020 inches thick, and more preferably at least 0.023 inches thick everywhere within the standing ring.

The body hook is at least 83 percent of the internal seam height, preferably at least 85 percent, and more preferably 88 percent of the internal seam height. The cover hook is no more than 98% of the internal seam height. The seam has a width dimension that is at least one percent greater than a sum of the metal component thicknesses across the seam plus 0.006 inches. And the sum of the metal component thicknesses of the seam is three times the end flange thickness plus two times the body flange thickness.

Preferably, at least a portion lower wall defines, in cross section, a straight line and the base outer wall is inclined at an angle approximately between 40 degrees and 60 degrees, and preferably approximately between 45 degrees and 55 degrees.

The can body is formed of an aluminum and in some embodiments is suitable for DOT rating of up to 140 psi, and even a DOT rating of up to 180 psi.

DETAILED DESCRIPTION OF PREFERRED EMBODIMENT

Figure 1:
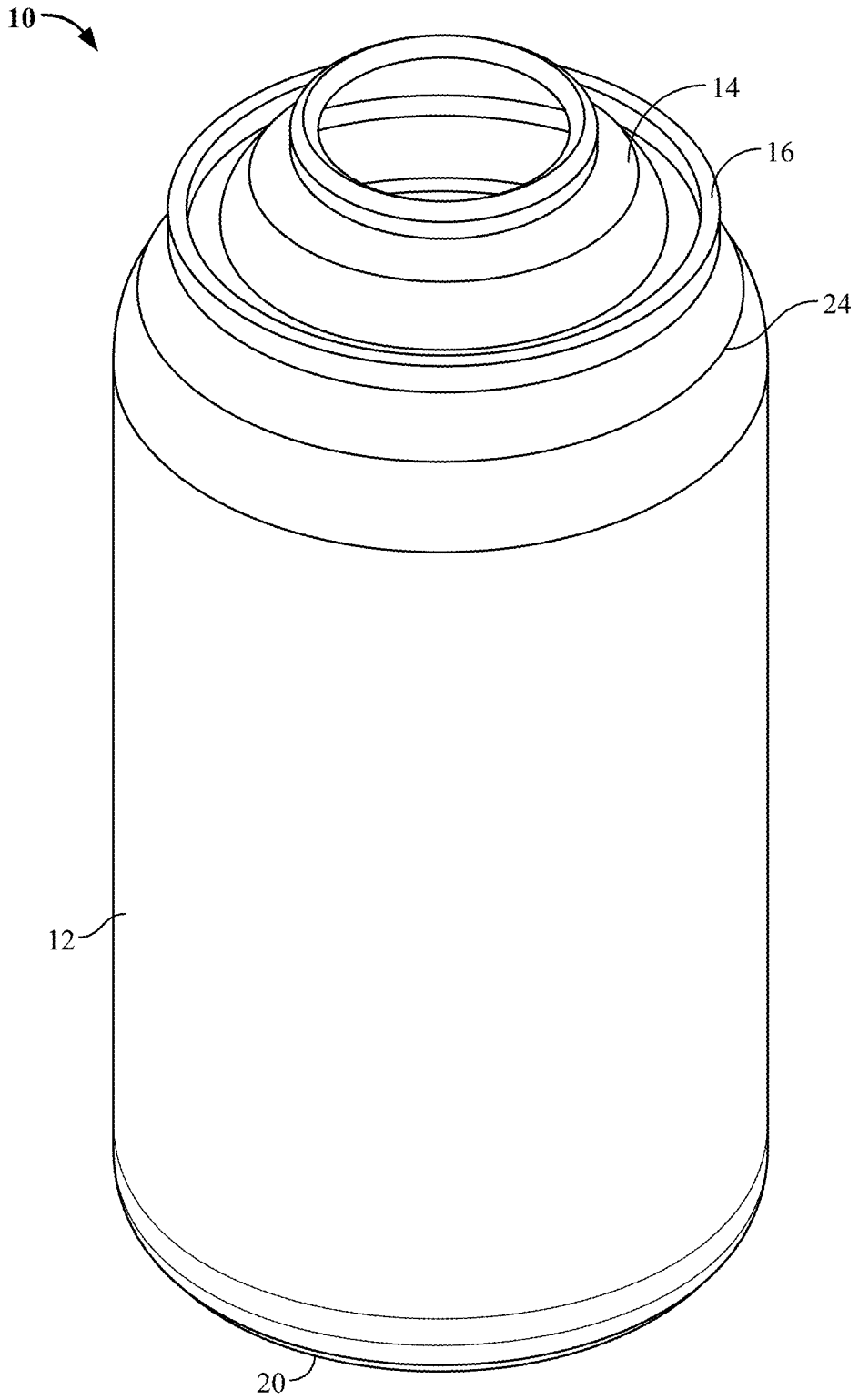
FIG. 1 is a perspective view of an aerosol can assembly illustrating aspects of the present invention.
Figure 2A:
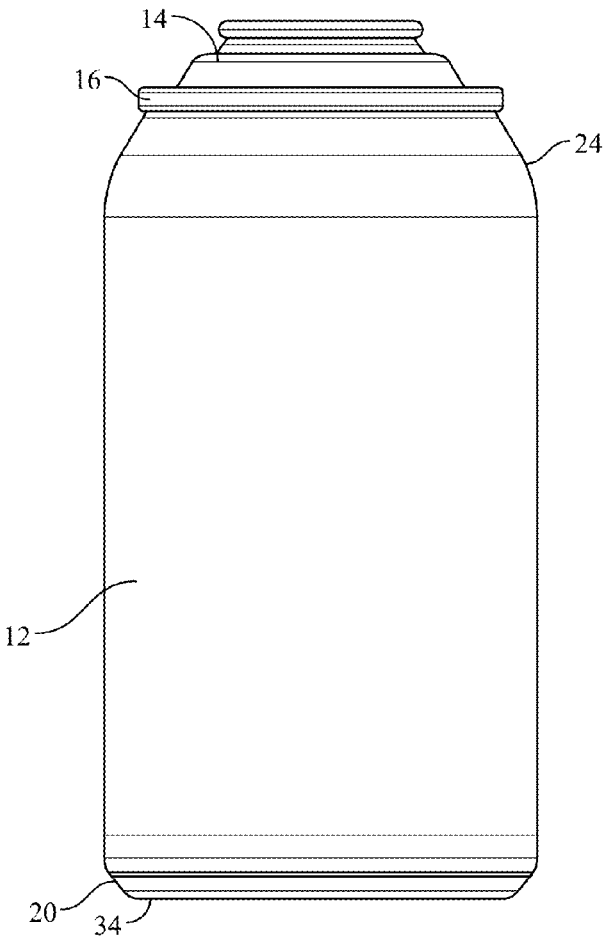
FIG. 2A is an elevation view of the can assembly of FIG. 1.
Figure 2B:
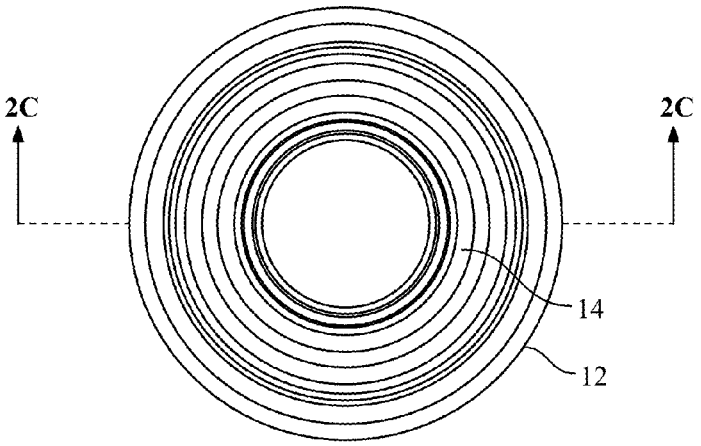
FIG. 2B is a top view of the can assembly of FIG. 1.

An aerosol can assembly 10 shown in FIG. 1 is used to illustrate aspects of the present invention. Can assembly 10 includes a can body 12, an aerosol-type end 14, and a seam formed from portions of the body and the end. Preferably, end 14 is a conventional, dome-type aerosol end formed of a conventional steel material. End 14 is seamed to can body 12 at its lower, outer end and has a curl for receiving a valve at its upper, inner end.

Figure 3A:
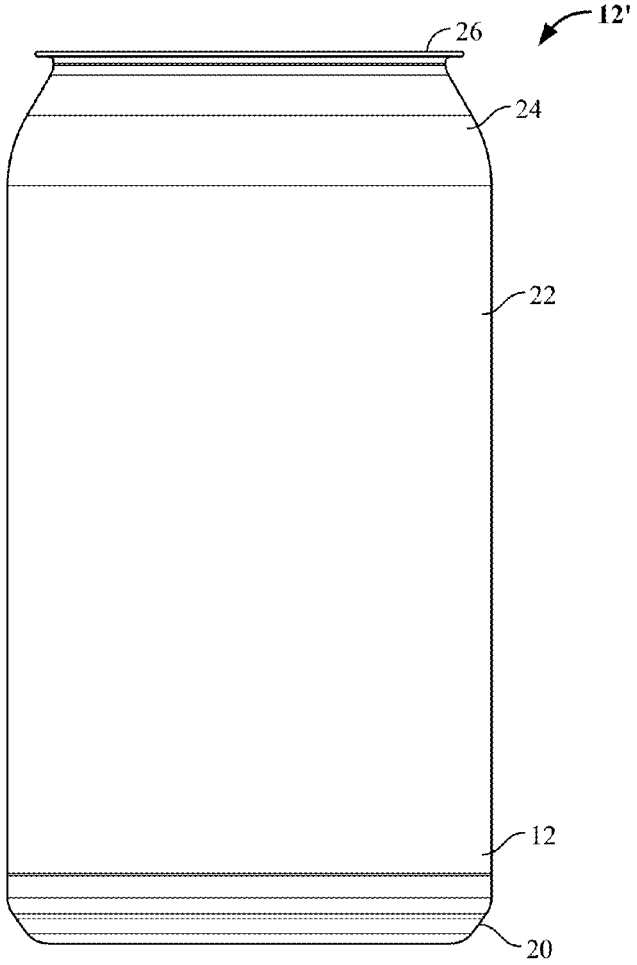
FIG. 3A is an elevation view a can body used to form the can assembly of FIG. 1.
Figure 3B:
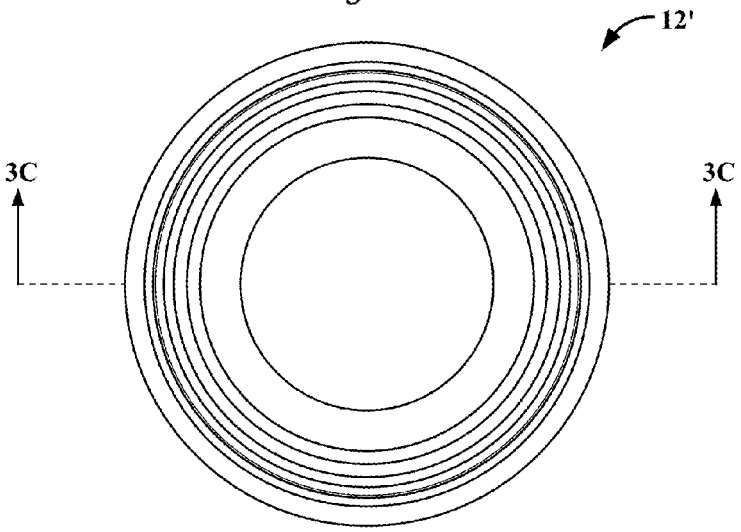
FIG. 3B is a top view of the can body of FIG. 3A.
Figure 3C:
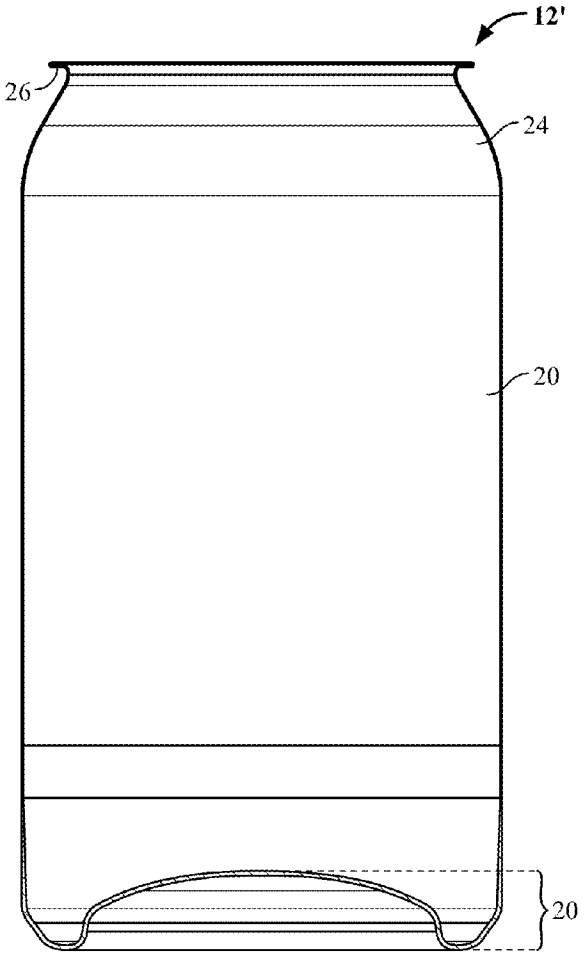
FIG. 3C is a cross-sectional view of the can body taken through line C-C in FIG. 3B.
Figure 2C:
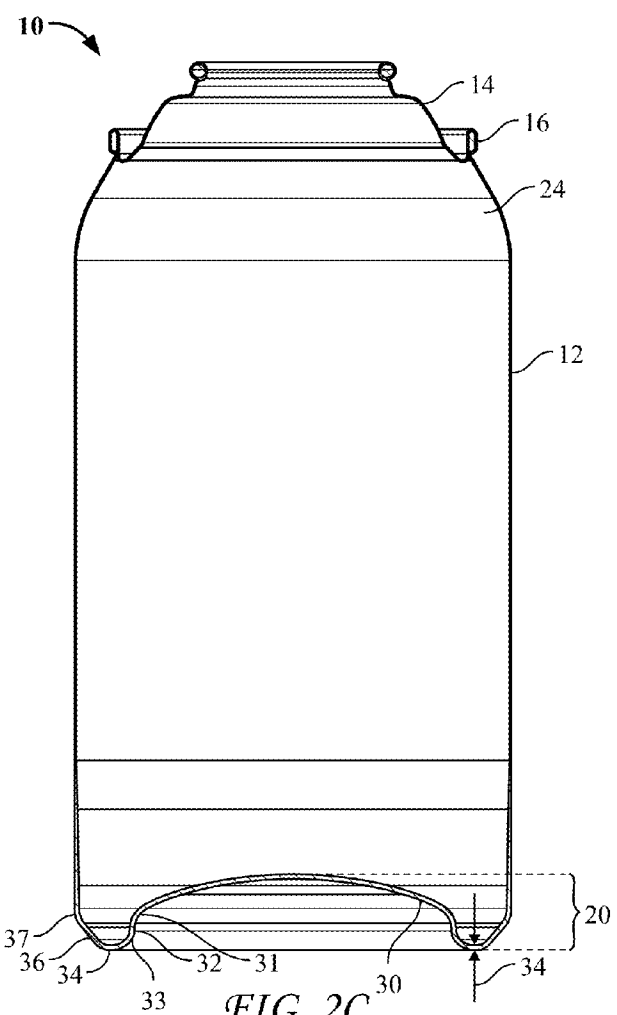
FIG. 2C is a cross-sectional view of the can assembly of FIG. 1 taken through line C-C in FIG. 2B.

Body 12 is shown in FIGS. 3A through 3C in its unseamed state, which is identified as body 12'. Body 12' includes a base 20, a sidewall 22, a neck 24, and a flange 26. Flange 26 is an outwardly extending curl that is suitable for forming a double seam. Flange 26 is smoothly merges into neck 24, which is a tapered and frusto-conical. Neck 24 transitions into body cylindrical sidewall 22, which merges into base 20.

Body 12' is a continuous, on-piece structure that is formed from drawing a sheet metal blank and the ironing the sidewall. After wall ironing, neck 24 may be formed by conventional necking technology, and flange 26 may be formed by a conventional flanging station after necking. Preferably, body 12 has an outer diameter D2, which in the embodiment shown is formed of a conventional size, such as a 211 size.

Base 20 includes a central dome 30, an inner wall 32, a standing ring 34, and an outer wall 36. Dome 30 has a height D3 measured from the upper surface of the center of the dome to the upper surface of the standing ring. Because the thickness of the standing ring is expected to be the same or nearly the same as the thickness of the dome, dimension D3 also may be measured from the plane of the standing ring to the underside of the center of dome 30. Dimension D3 preferably is approximately between 0.38 inches and 0.48 inches, and preferably about 0.43 inches. Dome 30 yields to inner wall 32 at a transition 31, which in the preferred embodiment has a radius of approximately 0.11 inches.

Figure 4:
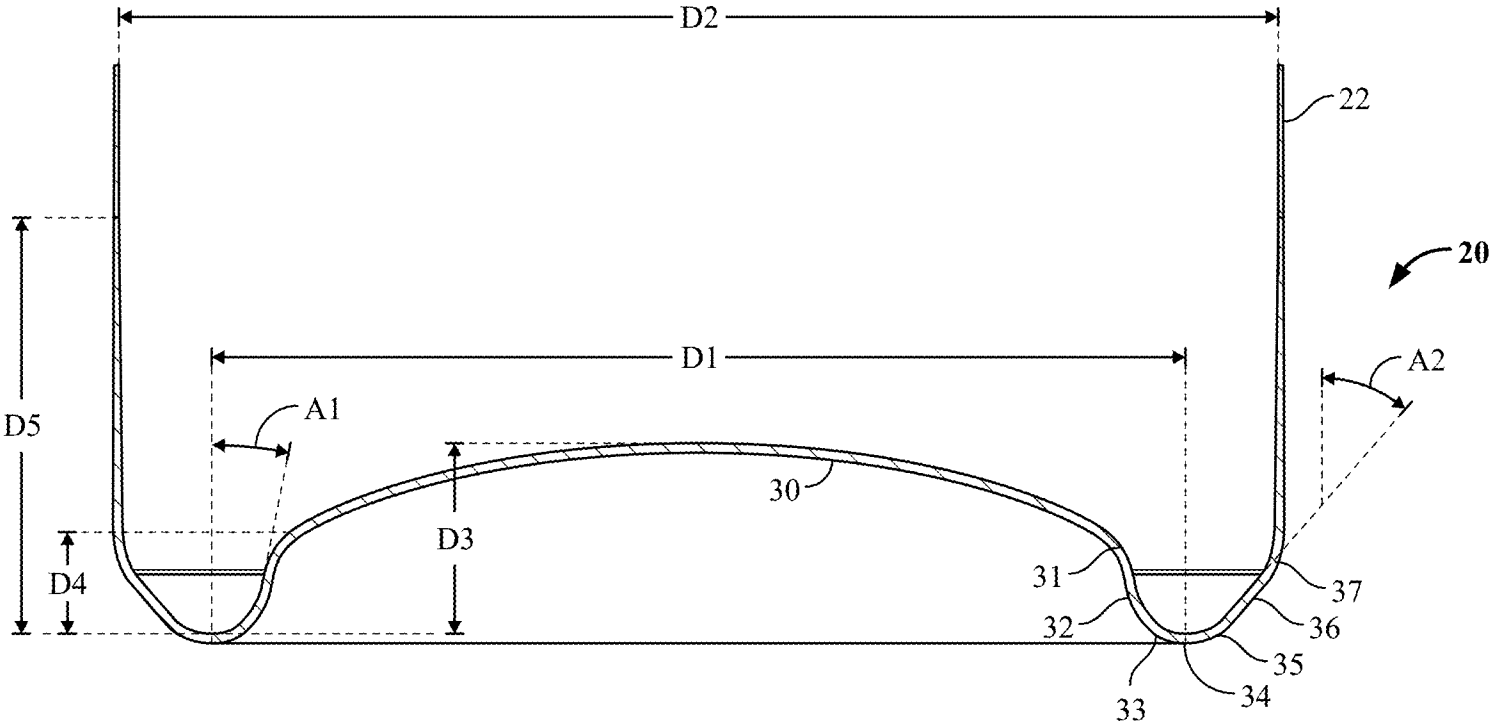
FIG. 4 is an enlarged view of a cross section of a base of the can body of FIG. 3A.

Inner wall 32 preferably is straight in cross section at an angle A1 which is approximately between 11 degrees and 13 degrees, and in the embodiment shown in the figures about 9 degrees, as best shown in FIG. 4. The present invention encompasses reformed inner walls (not shown). Inner wall 32 smoothly merges into an upwardly opening, curved standing ring 34.

Standing ring 34 defines a continuous circular ring that contacts and rests on a planar surface when can 10 is upright. The lowermost bead-like part of standing ring 34 may have a radius of between 0.11 inches and 0.17 inches, and in the embodiment shown in the figures 0.14 inches. Standing ring 34 defines a dimension D1, defined between opposing lowermost points on the underside of standing ring 34 (that is, the part that contacts the planar surface), that preferably is at least 78 percent of sidewall diameter D2, more preferably more than 80 percent, more preferably about 82 percent of the sidewall diameter D2. Standing ring 34 smoothly merges into outer wall 36 at a transition 35.

Outer wall 36 includes a straight section or bevel that is inclined at an angle A2 measured from a vertical line of between 40 degrees and 60 degrees, preferably between 45 degrees and 55 degrees, and in the embodiment of the figures approximately 50 degrees. Outer wall 36 merges into sidewall 22 at a transition 37 at a height D4 approximately between 0.13 to 0.23 inches and preferably about 0.18 inches.

The material thickness of the aluminum in base 20 is approximately uniform, as the preferred method for forming base 20 is by drawing. Preferably, the material in base 20 is at least 0.018 inches thick, more preferably at least than 0.020 inches thick, more preferably at least 0.022 inches thick, and in the embodiment shown in the figures approximately 0.023 inches thick. The base thickness may be up to 0.025 inches or higher. The above values for base thickness may be measured at the lowermost point of standing ring 34, or may be averaged among representative thicknesses of the dome, standing ring, and outer wall. Also, the above values may be minimum values anywhere in base 20.

Values or magnitudes of the standing ring diameter D1 to body diameter D3, the angle A2, and the length of outer wall 36 present tradeoffs between forming a stronger dome and supporting the outer portion of the sidewall at greater pressures. Can assembly 10 has a greater base thickness 20 than is typical for drawn and ironed beverage cans, which together with some or all of the features of the configuration described herein, enables can assembly 10 to achieve unrated, 2P, or 2Q pressure ratings.

Figure 5B:
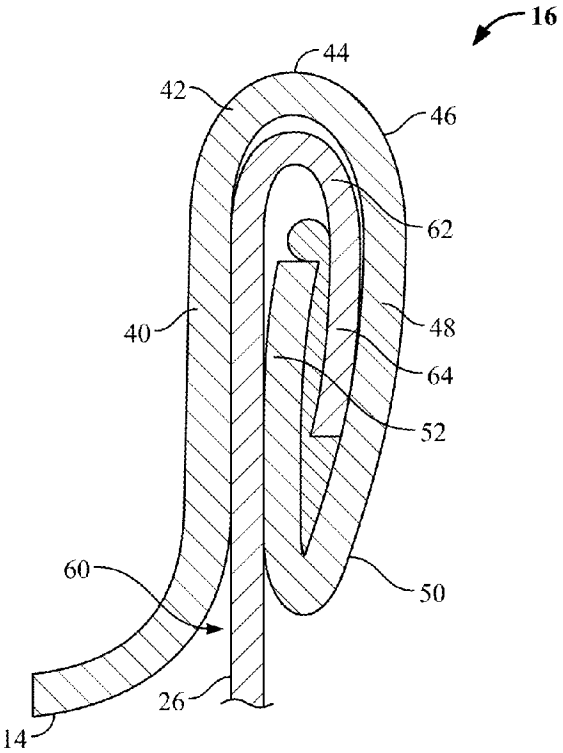
FIG. 5B is an enlarged, schematic view of a double seam.
Figure 5A:
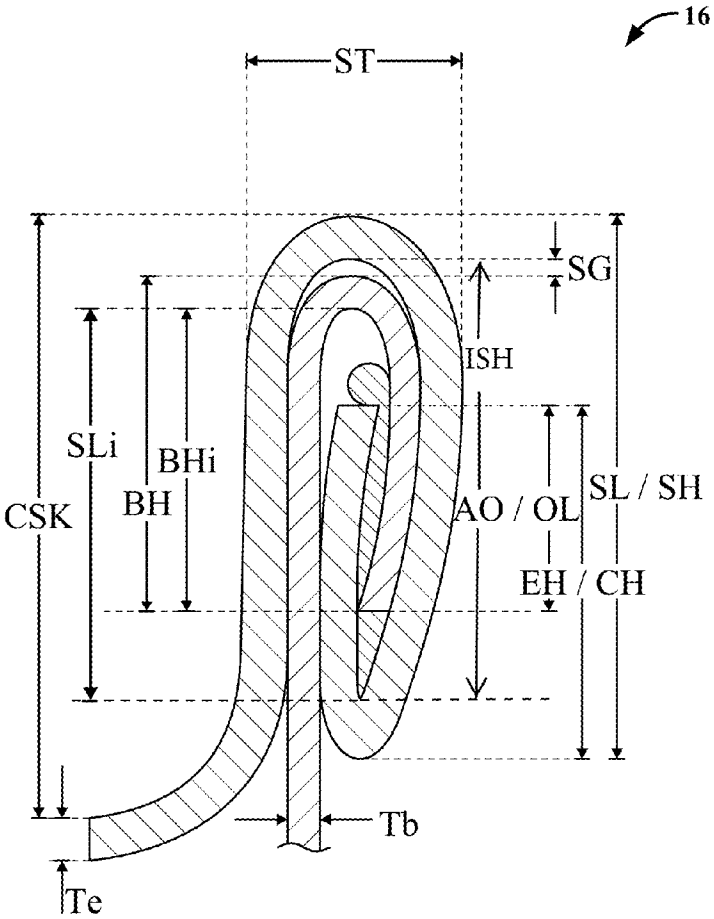
FIG. 5A is an enlarged, schematic view of a double seam showing dimensions.
Figure 6:
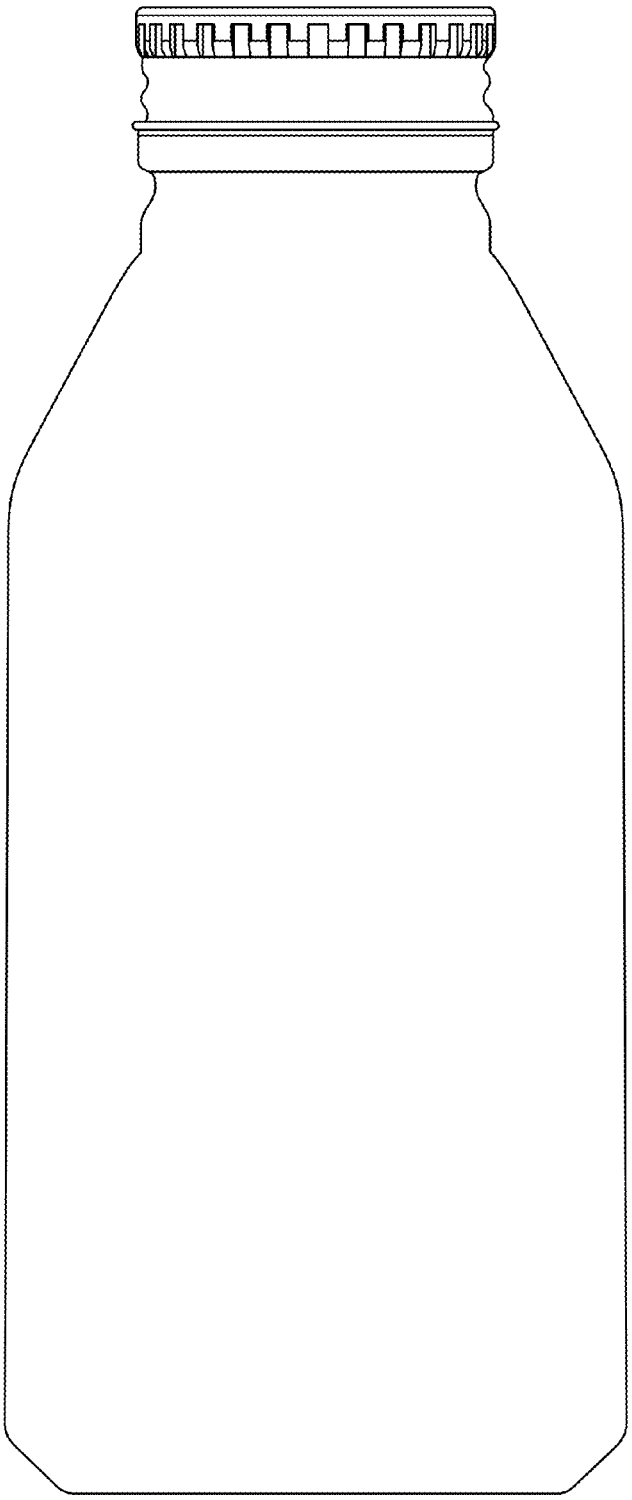
FIG. 6 (Prior Art)
FIG. 6 (Prior Art) is an elevation view of a prior art beverage can.

As illustrated in FIGS. 5A and 5B, seam 16 includes portions of flange 26 and end 14 that are formed into a double seam. The steel end includes portions of seam 16 referred to as a chuck wall 40 that yields to a seaming panel 44 at the uppermost part of seam 16 via or defining a seaming panel radius 42. Seaming panel 44 on its outboard side yields to seaming wall radius 46. An outer wall 48 extends downwardly from seaming wall radius 46 to an end hook at end hook radius 50 that defines the lowermost point of seam 16. A cover hook 52 that is internal to seam 16 extends upwardly from end hook 50.

The aluminum can body includes portions of seam 16, including a body wall that extends upwardly into the interior of seam 16 to a curved body hook radius 62. A body hook 64 extends downwardly from body hook radius 62 to contact outer wall 48 and extend toward end hook 50.

The dimensions of seam 16 include countersink depth CSK, a seam thickness ST measured between outside surfaces of chuck wall 40 and outer wall 48, a seam height SH measured between the lowermost point of end hook 50 and the uppermost point of seaming panel 44, an internal seam height ISH measured from the inside surface of end hook 50 and the inside surface of seaming panel 44 (internal seam height ISH is approximately the seam height SH minus two times the material thickness), a body hook height BH measured between the lowermost end of body hook 64 and the uppermost point of body hook radius 62, a cover hook height CH measured between the lowermost point of end hook 50 and the uppermost point of cover hook 52, and on overlap height OL measured between the lowermost point of body hook 64 and an uppermost point of cover hook 52.

As stated in the Background section, the prior art includes aerosol cans formed of steel ends on steel bodies, aluminum ends on aluminum bodies, and aluminum ends on steel bodies, but the inventors are not aware of steel aerosol ends on aluminum aerosol can bodies. One aspect (among others) of the present invention addresses an esoteric failure problem present in a double seam of an aluminum body with a steel end. The inventors surmise that because of the difference in the moduli of elasticity of steel and aluminum (such as a 3000 series alloy, specifically 3104 alloy; other aluminum alloys, such as a 6000 series alloy are contemplated) of the can body 12, which is common for drawn and wall ironed can bodies), common aerosol pressures cause the aluminum portion of the seam to fail at the top of body hook 64 at or near body hook radius 62. This phenomenon tends not to occur when a steel body is used with a steel end because the steel body hook and body hook radius are better able to resist the forces created between steel portions 40 and 48 and between portions 42 and 46 upon pressurization and during seaming.

To address the failure problem in light of the inventor's insight into the failure problem, seam 16 employs certain dimensions and parameters. In this regard, a ratio of body hook height BH to inside seam height SHI provides improved resistance to seam fracture. Body hook height BH has a dimension that is at least 83 percent, preferably at least 85 percent, of the inside seam height SHI. Prior art double seams of the type discussed herein, for beverage cans, typically have a body height BH to inside seam height SHI ratio of approximately 80 percent to 85 percent, and even 70% to 90 percent is allowable. The inventor surmises that a BH/SHI ratio of up to 99 percent is theoretically possible, but for practical reasons (for example, lack of concentricity of the end to the can body and manufacturing tolerances) there should be a gap between the end of the body hook 64 and the crux of the end hook 50.

Further, the inventor has determined that loosening the seam tightness diminishes the fracture problem while maintaining seam performance. In this regard, seam thickness ST for beverage cans is generally no more than 0.006 inches plus three times the can end flange thickness plus two times the body flange thickness (that is, 0.006 inches plus the total dimensions of the metal summed horizontally across the seam), which dimension is referred in this specification as "conventional seam thickness limit." The inventor surmises that loosening the seam between 1 percent and 15 percent and more preferably between 3 percent and 12 percent of conventional seam dimension provides improved performance.

Aspects of the present invention have been described by an illustration of a preferred embodiment. The present invention is not limited to the dimensions or configurations of the preferred embodiments, nor to the groups of features as arranged in the summary, unless stated in the claims.

The invention claimed is:

1. An aerosol can assembly comprising:

a steel end having an opening for receiving a valve assembly;

a one-piece, drawn and wall ironed, aluminum can body that includes an base, a sidewall, and a neck; and a double seam formed between the steel end and the aluminum body, the seam including a seaming panel, an end hook and a body hook;

the seam defining an internal seam height defined between an inner surface of the end hook and an inner surface of the seaming panel and the body hook defining a body hook height measured between a lowermost end of the body hook and an uppermost point of a body hook radius, the body hook height being at least 83 percent of the internal seam height.

2. The can assembly of claim 1 wherein the body hook height is at least 85 percent of the internal seam height.

3. The can assembly of claim 1 wherein the body hook height is at least 88 percent of the internal seam height.

4. The can assembly of claim 1 wherein the seam further includes a cover hook that extends upwardly from the end hook and the cover hook defines a cover hook height measured between a lowermost point of the end hook and an uppermost point of cover hook, the cover hook being no more than 98% of the internal seam height.

5. The can assembly of claim 1 wherein the seam defines a radial width dimension that is at least one percent greater than a sum of the metal component thicknesses across the seam plus 0.006 inches.

6. The can assembly of claim 1 wherein the seam defines a radial width that is three times the end flange thickness plus two times the body flange thickness.

7. The can assembly of claim 1 wherein a standing ring diameter is at least 78 percent of the can body outside diameter.

8. The can assembly of claim 1 wherein a standing ring diameter is at least 80 percent of the can body outside diameter.

9. The can assembly of claim 1 wherein a standing ring diameter is at least 82 percent of the can body outside diameter.

10. The can assembly of claim 1 wherein the base is at least 0.018 inches thick everywhere within a standing ring.

11. The can assembly of claim 1 wherein the base is at least 0.020 inches thick everywhere within a standing ring.

12. The can assembly of claim 1 wherein the base is at least 0.023 inches thick everywhere within a standing ring.

13. The can assembly of claim 1 wherein at least a portion of the lower wall defines, in cross section, a straight line.

14. The can assembly of claim 1 wherein the base includes a base outer wall between a standing ring and the sidewall, the base outer wall is inclined at an angle approximately between 40 degrees and 60 degrees.

15. The can assembly of claim 12 wherein the base outer wall is inclined at an angle approximately between 45 degrees and 55 degrees.

16. The can assembly of claim 1, wherein the can body is configured to have a burst requirement of at least 270 psi.

17. The can assembly of claim 1, wherein the can body is configured to have a burst requirement of at least 210 psi.

18. A method for seaming a steel aerosol end to an aluminum aerosol can body, comprising the steps of:

locating a steel end relative to a one-piece, drawn and wall ironed, aluminum can body that includes an base, a sidewall, and a neck; and forming a double seam between the steel end and the aluminum can body such that the seam includes a seaming panel, an end hook, and a body hook; the seam defining an internal seam height defined between an inner surface of the end hook and an inner surface of the seaming panel and the body hook defining a body hook height measured between a lowermost end of the body hook and an uppermost point of a body hook radius, the body hook height being at least 83 percent of the internal seam height.

19. The method of claim 18 the seam defines a radial width dimension that is at least one percent greater than a sum of the metal component thicknesses across the seam plus 0.006 inches.

20. The method of claim 19 the seam defines a radial width that is three times the end flange thickness plus two times the body flange thickness.

21. The method assembly of claim 18 wherein the length of the body hook is at least 85 percent of the internal seam height.

22. The method assembly of claim 18 wherein the length of the body hook is at least 88 percent of the internal seam height.

23. The method assembly of claim 18 wherein the body hook is no more than 98% of the internal seam height.

24. The method of claim 18 wherein the base includes a dome, a circular standing ring located outboard of dome, and an outer wall located between the standing ring and a bottom of the sidewall; and the standing ring has a diameter that is at least 78 percent of the outside diameter of the sidewall.

25. The method of claim 24 wherein the standing ring diameter is at least 80 percent of the can body outside diameter.

26. The method of claim 24 wherein the standing ring diameter is at least 82 percent of the can body outside diameter.

27. The method of claim 24 wherein the base is at least 0.018 inches thick everywhere within the standing ring.

28. The method of claim 24 wherein the base is at least 0.020 inches thick everywhere within the standing ring.

29. The method of claim 24 wherein the base is at least 0.023 inches thick everywhere within the standing ring.

30. The method of claim 24 wherein at least a portion of the outer wall defines, in cross section, a straight line.

31. The method of claim 24 wherein the base outer wall is inclined at an angle approximately between 40 degrees and 60 degrees.

32. The method of claim 24 wherein the base outer wall is inclined at an angle approximately between 45 degrees and 55 degrees.

33. The method of claim 18 wherein the can body is configured to have a burst requirement of at least 270 psi.

34. The method of claim 18 wherein the can body is configured to have a burst requirement of at least 210 psi.

* * * * *